US008596212B2

(12) United States Patent
Perkins

(10) Patent No.: US 8,596,212 B2
(45) Date of Patent: Dec. 3, 2013

(54) APPARATUS AND METHOD FOR BOARDING ANIMALS ONTO A BOAT

(75) Inventor: James M. Perkins, Pewaukee, WI (US)

(73) Assignee: WAG Products, LLC, Pewaukee, WI (US)

( * ) Notice: Subject to any disclaimer, the term of this patent is extended or adjusted under 35 U.S.C. 154(b) by 320 days.

(21) Appl. No.: 13/097,972

(22) Filed: Apr. 29, 2011

(65) Prior Publication Data

US 2012/0273303 A1 Nov. 1, 2012

(51) Int. Cl.

| | |
|---|---|
| ***B63B 27/14*** | (2006.01) |
| ***E06C 1/04*** | (2006.01) |
| ***E06C 1/36*** | (2006.01) |
| ***E06C 5/00*** | (2006.01) |
| ***E06C 5/40*** | (2006.01) |

(52) U.S. Cl.

USPC ..... 114/362; 119/847; 182/93; 182/165; 182/206

(58) Field of Classification Search

USPC ..... 114/343, 362; 182/120–122, 127, 150, 182/206, 93, 97, 165, 170; 119/843, 119/847–849

See application file for complete search history.

(56) References Cited

U.S. PATENT DOCUMENTS

| | | | | | |
|---|---|---|---|---|---|
| 146,274 | A | * | 1/1874 | Parent | 182/106 |
| 2,536,966 | A | | 1/1951 | Teller | |
| 2,876,047 | A | * | 3/1959 | La Plante | 182/206 |
| 3,159,141 | A | | 12/1964 | Paterek | |
| 3,503,468 | A | * | 3/1970 | Taylor, Sr. | 182/121 |
| 3,891,053 | A | | 6/1975 | Burton | |
| 4,186,820 | A | | 2/1980 | Cosman et al. | |
| 4,241,807 | A | * | 12/1980 | McKenna et al. | 182/121 |
| 4,293,967 | A | | 10/1981 | Ord | |
| 4,538,314 | A | | 9/1985 | Baranowski | |
| 4,722,420 | A | * | 2/1988 | Arthurs et al. | 182/93 |
| 4,724,925 | A | | 2/1988 | Ritten | |
| 4,907,673 | A | | 3/1990 | Ginter et al. | |
| 4,989,691 | A | | 2/1991 | Wilkerson et al. | |
| 4,998,982 | A | * | 3/1991 | Arnold et al. | 182/159 |
| 5,515,806 | A | | 5/1996 | McCabe | |
| 5,592,801 | A | | 1/1997 | Balzer | |
| 5,829,380 | A | | 11/1998 | Smith | |
| D440,717 | S | | 4/2001 | Fazio | |
| 6,267,082 | B1 | | 7/2001 | Naragon et al. | |
| 6,401,861 | B1 | * | 6/2002 | Marszalek | 182/84 |
| 6,578,510 | B1 | | 6/2003 | Scruggs et al. | |
| 6,598,562 | B1 | | 7/2003 | Dutkiewicz et al. | |
| 6,941,823 | B1 | | 9/2005 | Lai et al. | |
| 6,941,889 | B1 | | 9/2005 | McCrocklin et al. | |
| 6,983,823 | B1 | | 1/2006 | Zumbrunnen | |
| 7,011,036 | B1 | | 3/2006 | Hill | |
| 2003/0106173 | A1 | | 6/2003 | Miller | |
| 2006/0272895 | A1 | * | 12/2006 | Lavoie | 182/127 |

FOREIGN PATENT DOCUMENTS

| | | | |
|---|---|---|---|
| DE | 4306733 | A1 * | 9/1994 |

* cited by examiner

*Primary Examiner* — Ajay Vasudeva

(74) *Attorney, Agent, or Firm* — Ryan Kromholz & Manion, S.C.

(57) ABSTRACT

A boat boarding apparatus for boarding animals onto a boat and methods of using the apparatus. The apparatus has a set of boat boarding steps, a first mounting assembly attached to said boarding steps for connecting said boarding steps to said boat ladder and a second mounting assembly for connecting said boarding steps to said boat ladder. The mounting assemblies provide resistance forces for securing the ladder, with the resistance forces being opposing forces to one another.

17 Claims, 6 Drawing Sheets

APPARATUS AND METHOD FOR BOARDING ANIMALS ONTO A BOAT

BACKGROUND OF THE INVENTION

The present invention relates generally to an apparatus for accessing a boat, and particularly to a ladder apparatus attachable to a boat ladder for boarding animals from the water into the boat.

It is common for animals to accompany their owners on boat trips. During these trips, the human owners as well as the animals, choose to enter the water. Reboarding the boat from the water is a challenge for many reasons, including forces by currents and waves, as well as lack of ground support on which to push off to re-board the boat. This is especially difficult for animals, such as dogs, that cannot make use of the boat ladder that is designed to assist humans. Furthermore, animals, such as dogs, are unable to pull themselves up onto the boat as humans can. Therefore, it is often the owners themselves who have the difficult task of retrieving their animal from the water. Not only is this a challenge, but it also involves getting wet and is potentially dangerous for both the humans and the animals.

As such, there is a need for a boarding device to assist house pet animals, such as dogs, onto the boat from the surrounding water. There are such devices presently available, but these devices are unstable, inconvenient, unable to attach to different boat ladder designs, and may be difficult to configure for use and transport and attach or detach. In addition, the design of many prior devices makes those devices susceptible to high external forces. The external forces are due to the high surface area of the devices in the planes of the water movement and may cause high degrees of movement relative to the boat ladder. This can be intimidating to the animal and may discourage use. This movement can also result in damage to the boat ladder and/or damage to the boarding apparatus, with the potential for injuring the animal. Thus, there remains a need for a stable, convenient, simple, and universally adaptable animal boarding apparatus, with a design that minimizes the presence and effect of external forces.

SUMMARY OF THE INVENTION

In view of these drawbacks, the present invention is a boat boarding apparatus for animals, such as dogs, designed to attach to an existing boat ladder that is built into the boat design. The apparatus comprises a set of boat boarding steps, a first mounting assembly attached to said boarding steps for connecting said boarding steps to said boat ladder and a second mounting assembly for connecting said boarding steps to said boat ladder. The mounting assemblies provide positive engagement via resistance forces for securing the steps, with the resistance forces being opposing forces to one another.

Another feature of the apparatus of the present invention is that the apparatus is generally adaptable to any existing boat ladder design. The boarding steps of the apparatus preferably comprises at least a pair of parallel runners and a plurality of spaced platforms spanning the space between the parallel runners, forming the steps.

The mounting assemblies are preferably attached to the parallel runners, preferably under the stairs. Each mounting assembly is configured to attach to an existing boat ladder by a pair of spaced apart hooks. In one embodiment of the invention, the first mounting assembly comprises a pivot bar that spans the parallel runners, a pair of spaced apart upper mounting arms each extending from the pivot bar and having a hook element at the distal end to grip the existing boat ladder, and a means for generating a force on the mounting arms of the first mounting assembly in the direction of the open portion of the hook (or towards the respective rung of the existing boat ladder). In contrast, the second mounting assembly is rigidly positioned. While adjustable by means of connector points on a pair of brace arms and apertures in a pair of mounting arms, once in the desired position, it remains rigid while attached to the boat.

In one preferred embodiment, the second mounting assembly comprises a pair of pivot bars spanning the space between the parallel runners, a pair of brace arms extending from a first pivot bar and configured to connect to lower mounting arms at connector points, and a pair of lower mounting arms extending from a second pivot bar and each having a hook at the distal end to grip the existing boat ladder.

The pair of hooks of the first and second mounting assemblies is configured in opposing directions, either towards the other or away from, to generate the opposing forces on the existing boat ladder. As such, the apparatus works with rigid, folding, and telescoping boat ladder designs. The present invention also minimizes the presence and effect of external forces due to its high open area in the x, y, and z planes, created by apertures in the parallel runners, the platforms forming the steps, and the open space between each platform. Additionally, the positive attachment by opposing force of this apparatus to the boat ladder also controls the movement of the steps relative to the boat ladder when subjected to these external forces.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1A:
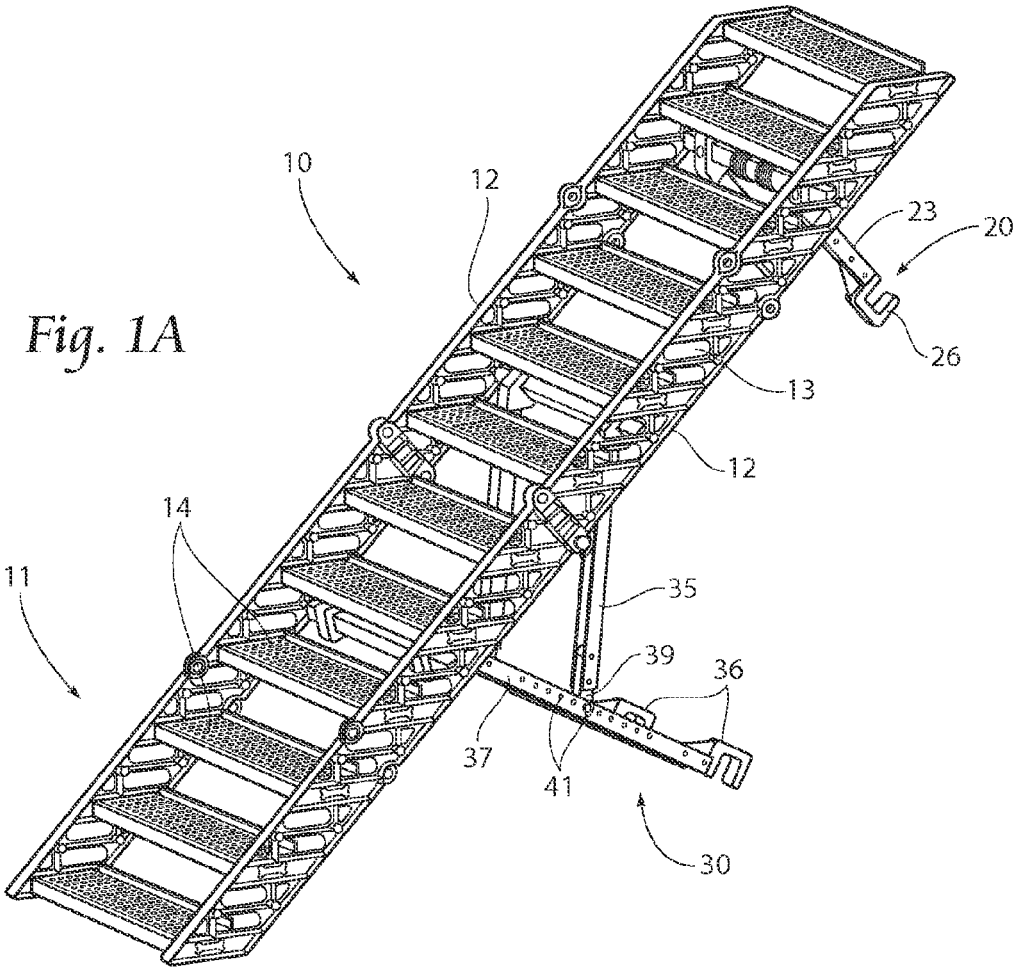
FIG. 1A is a top perspective view of a boat boarding apparatus for animals according to the present invention.
Figure 1B:
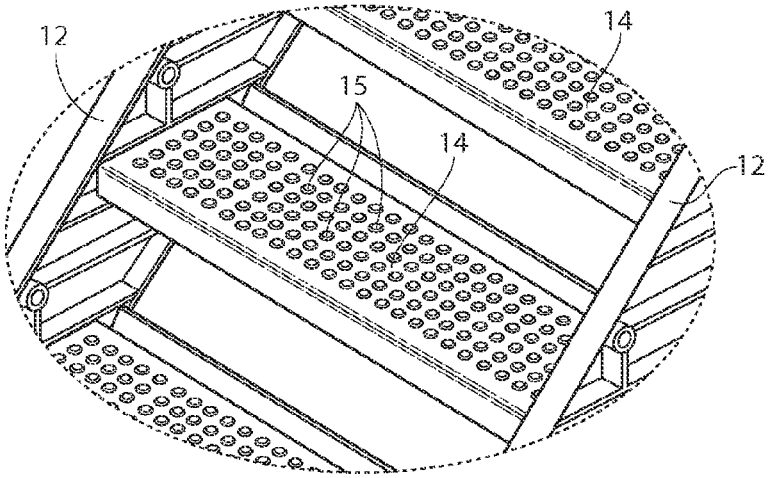
FIG. 1B is a close-up sectional view of a portion of the boarding steps shown in the boat boarding apparatus of FIG. 1A.
Figure 2:
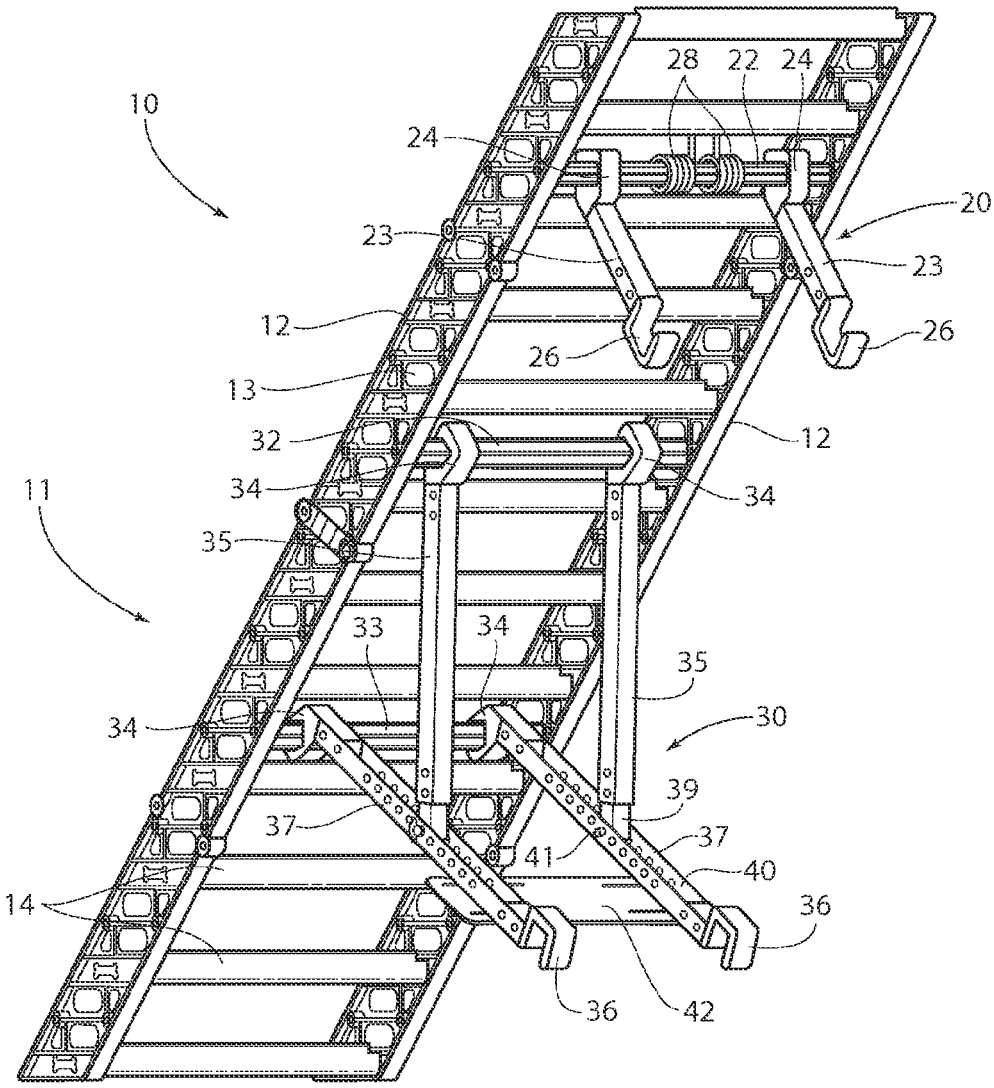
FIG. 2 is a rear perspective view of the device of FIG. 1A, showing the underside of the apparatus.
Figure 3:
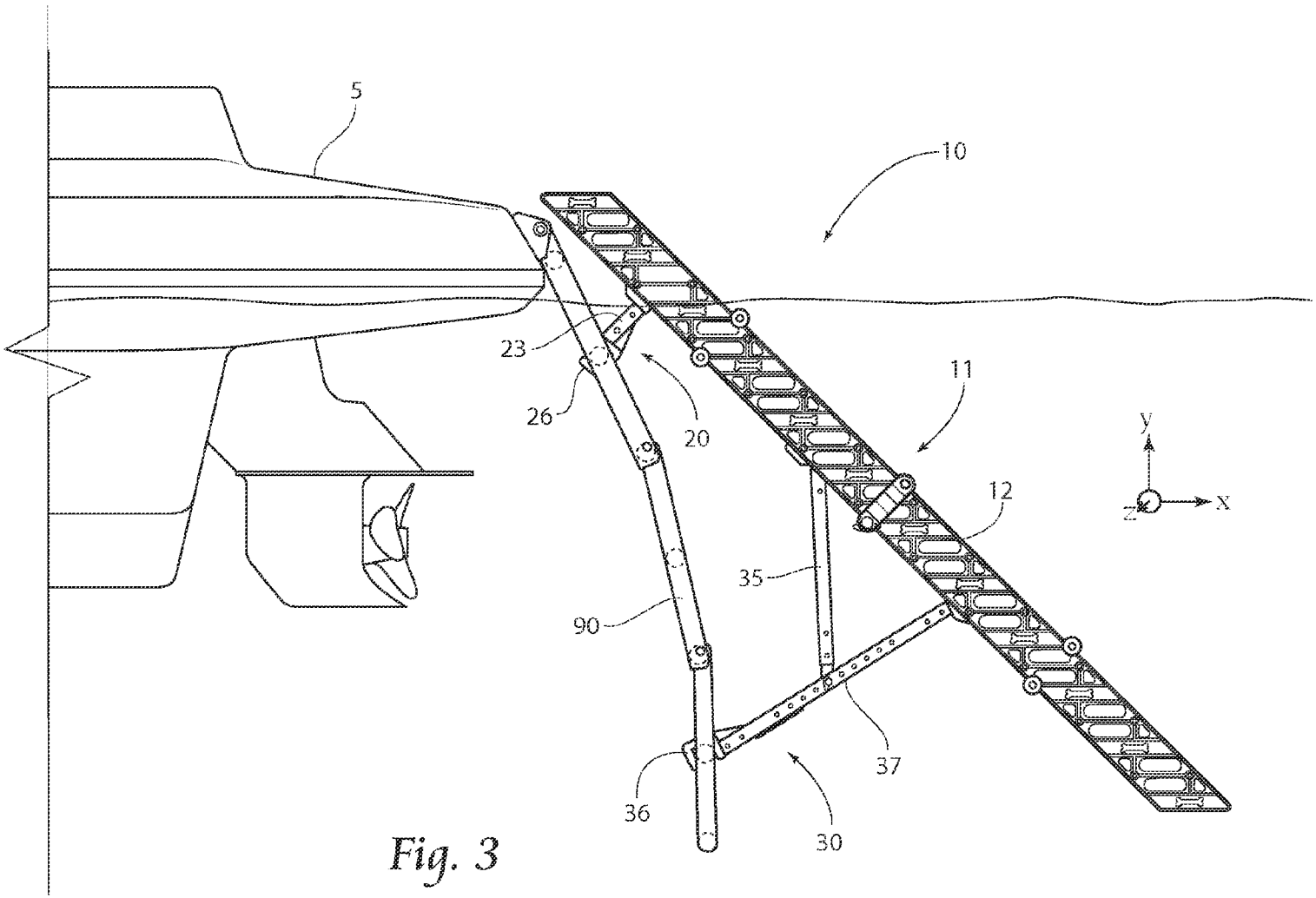
FIG. 3 is a side elevation view of the device of FIG. 1A, showing positive attachment to the existing ladder of a boat.

FIGS. 1A-2 show an embodiment of the present invention. A boat boarding apparatus 10 for animals, such as dogs, is shown and described. The apparatus 10 is configured to attach to the existing ladder 90 of a boat 5, as shown in FIG. 3. The apparatus 10 comprises a boat boarding steps 11. The boat boarding steps 11 can be of any shape or form that will assist an animal in boarding a boat from the water.

Still referring to FIGS. 1A-2, the steps 11 preferably comprises at least two elongated runners 12 positioned parallel to one another. Parallel refers to arrangements that are parallel or are essentially parallel to one another. A plurality of flat platforms 14 are spaced apart perpendicularly along the length of the elongated runners 12, 12*b*. These platforms 14 make up the steps of the ladder 11.

Another feature of the present invention is shown and described in FIGS. 1A and 1B. To limit stress and undue force on the apparatus from external forces, such as waves or wakes caused by other boats, the runners 12 may be designed with apertures 13 to increase the open area, and thus reduce external forces from the surrounding water on the apparatus 10 in the z-direction. Similarly, the platforms 14 may also include apertures 15 (see FIG. 1B) to increase the open area and reduce external forces in the y-direction. This configuration of the platforms 14 increases the open area and reduces external forces in the x-direction. This minimization of external forces is beneficial to minimize movement of the apparatus 10 with relation to the boat ladder 90 and reduce potential for damage to the apparatus 10, the ladder 90, and the boat 5.

Referring to FIGS. 2 and 3, the attachment of the apparatus 11 to the boat ladder 90 may be accomplished by way of a first mounting assembly 20 and a second mounting assembly 30. The first mounting assembly 20 is pivotable while engaged with the boat ladder 90, whereas the second mounting assembly 30 is rigid while engaged with the boat ladder 90.

As shown particularly in FIG. 2, the first mounting assembly 20 comprises a laterally extending pivot bar 22 that extends between the pair of runners 12 on the underside of the apparatus 10. The mounting assembly 20 also has at least one mounting arm and preferably at least a pair of mounting arms 23 that extend from the pivot bar 22 away from the apparatus 10. Because the boat ladder 90 may be of different configurations, the number of mounting arms 23 used in the mounting assembly 23 can be altered. For example, a boat ladder 90 may have one, two or more upright sections to support the rungs of the ladder 90. The mounting arms 23 can be positioned laterally adjacent to the upright section or sections of the boat ladder 90 to provide stability and limit relative lateral movement of the apparatus 11, and the number of arms 23 will be determinative on how many arms 23 may be necessary to stabilize the apparatus 11.

Still referring to FIG. 2, each mounting arm 23 is configured with an arm attachment ring 24 wherein the pivot bar 22 is held within the opening of the ring 24 and a hook 26 at the opposing end. The ring 24 may be of any shape or form, such as a clasp or clamp, that may sufficiently allow the assembly 20 to be connected to the ladder 11. The hook 26 is configured to grip a rung of the existing boat ladder 90. It should be understood that a hook will encompass any design or shape that will provide a positive engagement with the boat ladder 90. Further, the first mounting assembly 20 comprises a means 28 for exerting a force on the mounting arms 23. This means for exerting a force on the mounting arms 23 may be a torsion spring 28, as shown in FIG. 2, but may also be gas struts, compression springs, extension springs, elastic bands, or other compression, extension, or torsional means or other similar devices, depending on the configuration of the hooks and mounting assemblies, to generate a force on the mounting assemblies 20 and 30 (and respective hooks), as discussed further below and shown in FIGS. 4A and 4B.

Referring again to FIG. 2, the second mounting assembly 30 is rigidly positioned with respect to the ladder 11. The second mounting assembly 30 comprises two pivot bars that extend between the pair of runners 12 on the underside of the apparatus 10, an upper pivot bar 32 and a lower pivot bar 33. From the upper pivot bar 32, a pair of brace arms 35 extends away from the apparatus 10 and downwardly in the direction of the lower pivot bar 33. Each brace arm 35 is configured with an arm attachment ring 34 wherein the pivot bar 33 is held within the opening of the ring 24. Each of the mounting arms 37 is configured with an arm attachment member 34 that attaches around the lower pivot bar 33. The opposing end of each mounting arm 37 comprises a hook 36 that is configured to grip a rung of the boat ladder 90. The brace arms 35 and the mounting arms 37 come together at a connection point 39. At this connection point 39, the distal end of the brace arm 35 is configured to engage with one of a plurality of pairs of apertures 41 formed along a channel 40 extending along and within the length of the mounting arm 37. By disengaging the brace arm 35 from the apertures 41 at the connection point 39, and sliding the brace arm 35 within the channel 40 along the length of the mounting arm 37, and re-engaging the brace arm 35 with a pair of apertures 41 at a different connection point 39, the second mounting assembly 30 is adjustable to fit the boat ladder 90. A stabilizer or spacer 42 can also be used to further increase the stability of the mounting assembly 30 and may be of any shape that will further increase the stability of the assembly 30. The use of stabilizer 42 may be particularly advantageous if two or more arms 35 are used for the mounting assembly 30, and the use of the stabilizer 42 may assist the user when positioning the apparatus 11 during installation.

Figure 4A:
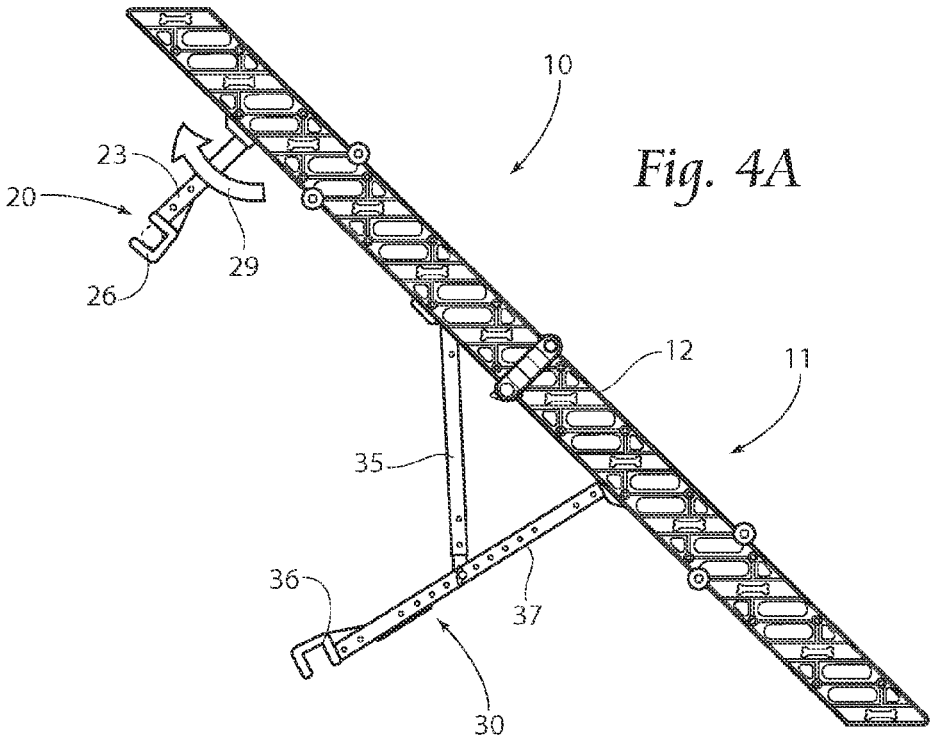
FIG. 4A is a side view of a boat boarding apparatus for animals according to the present invention, showing specifically the configuration of the pairs of hooks of the mounting assemblies.

In one embodiment, shown in FIG. 4A, the hooks 26, 36 of the first and second mounting assemblies 20, 30 respectively, are facing away from the other. In this embodiment, the first mounting assembly 20 grips an upper rung of the boat ladder 90, while the second mounting assembly 30 grips a lower rung of the ladder 90. In this embodiment, the force 29 on the mounting arms 23 of the first mounting assembly 20 is exerted away from the second mounting assembly 30. These opposing forces promote the positive connection of the apparatus 10 to the boat ladder 90. In this embodiment, the force 29 exerted on the mounting arms may be by means of a torsion spring 28, as shown in FIG. 2, or may also be gas struts, compression springs, or other force means to push the pairs of mounting arms 23, 37 away from each other.

Figure 4B:
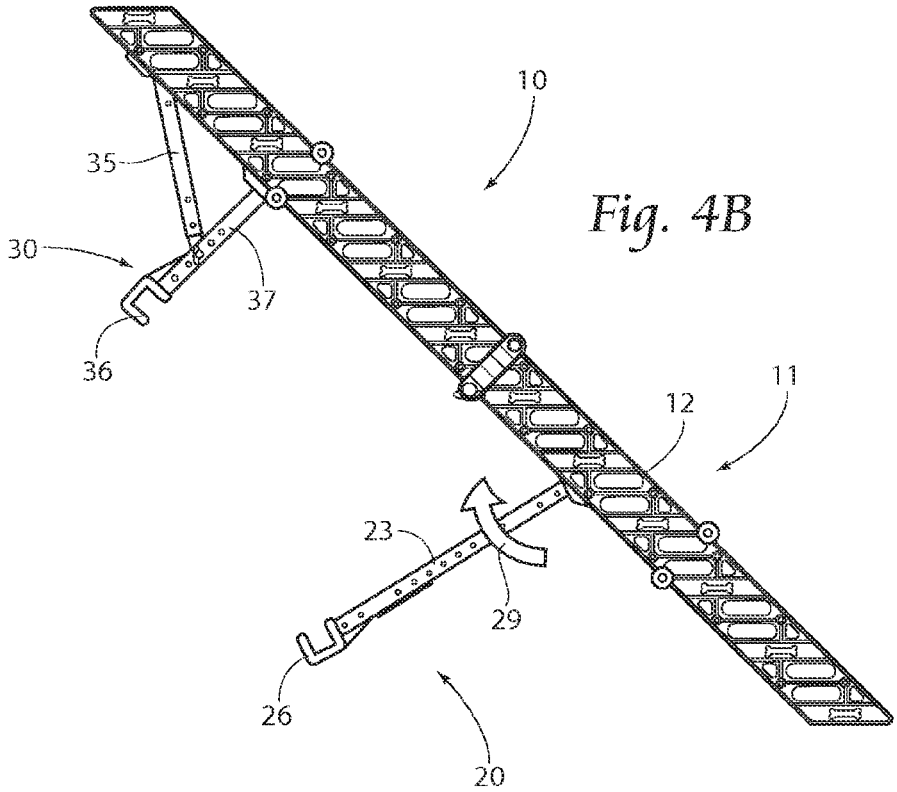
FIG. 4B is a side view of a boat boarding apparatus for animals according to the present invention, showing specifically an alternative configuration of the pairs of hooks of the mounting assemblies.

In a second embodiment, shown in FIG. 4B, the hooks 26, 36 of the first and second mounting assemblies 20, 30 respectively, are facing towards the other. In this embodiment, the first mounting assembly 20 grips a lower rung of the boat ladder 90, while the second mounting assembly 30 grips an upper rung of the ladder 90. In this embodiment, the force 29 on the mounting arms 23 of the first mounting assembly 20 is exerted toward the second mounting assembly 30. These opposing forces promote the positive connection of the apparatus 10 to the boat ladder 90. In this embodiment, the force 29 exerted on the mounting arms may be by means of a torsion spring 28, as shown in FIG. 2, or may also be elastic bands, extension springs or other force means to pull the pairs of mounting arms 23, 37 towards each other. Either configuration is within the scope of this invention, so long as the pairs of hooks 26, 36 are positioned in opposing directions so as to generate the opposing force necessary to securely attach to the boat ladder 90. Provided that the opposing force is generated with the mounting assemblies, a design should be understood as falling within the scope of the present invention.

The invention also discloses a method for using the apparatus 10 in conjunction with a boat ladder 90, as shown in FIG. 3. The apparatus 10 is positioned with the second, rigid mounting assembly 30 in place on a rung of the ladder 90. The first mounting assembly, having the pair of spring-loaded mounting arms 23, is pulled against the force created by the force means 28, such as a torsion spring. Once in position, the applied force is released and the force means 28, such as a torsion spring, act to bring the mounting arms 23 and hooks 26 toward the rung and into engagement with the rung of the ladder 90. To remove, the pair of spring-loaded mounting arms 23 and hooks 26 is pulled away from the rung by exerting a force opposite the direction of the force means, such as a torsion spring 28, and then moving the apparatus 10 away from the boat ladder 90.

Figure 5A:
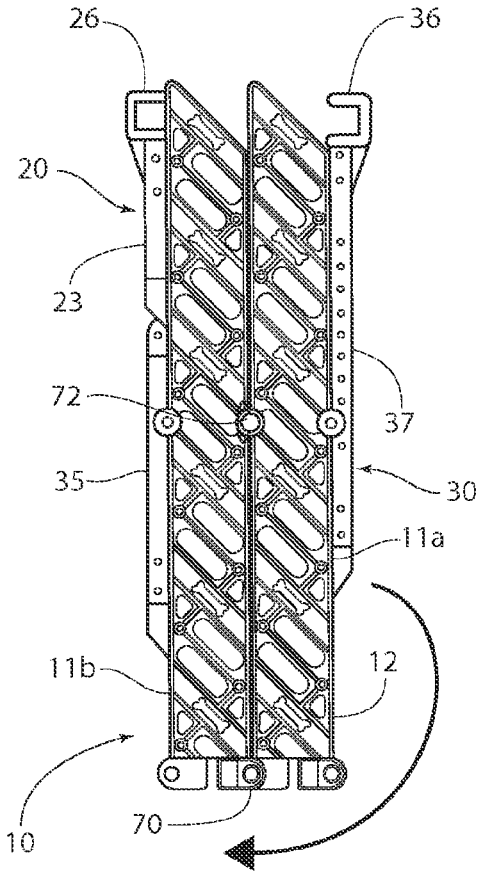
FIGS. 5A-5C demonstrate the process of configuring the boat boarding apparatus of the present invention between a storage and transport position and an operating position.
Figure 5B:
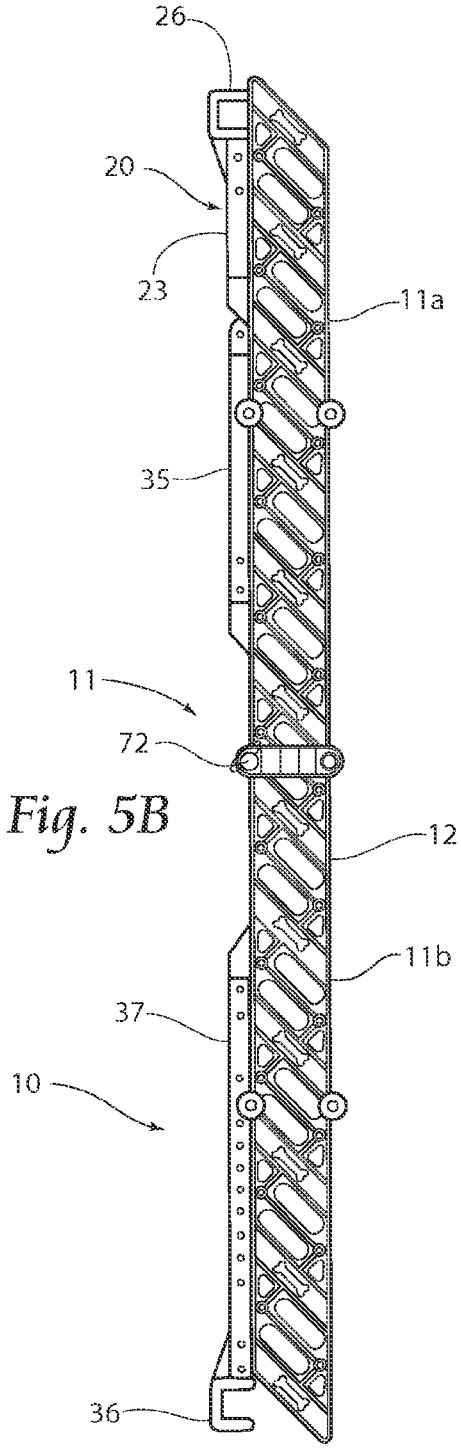
Figure 5C:
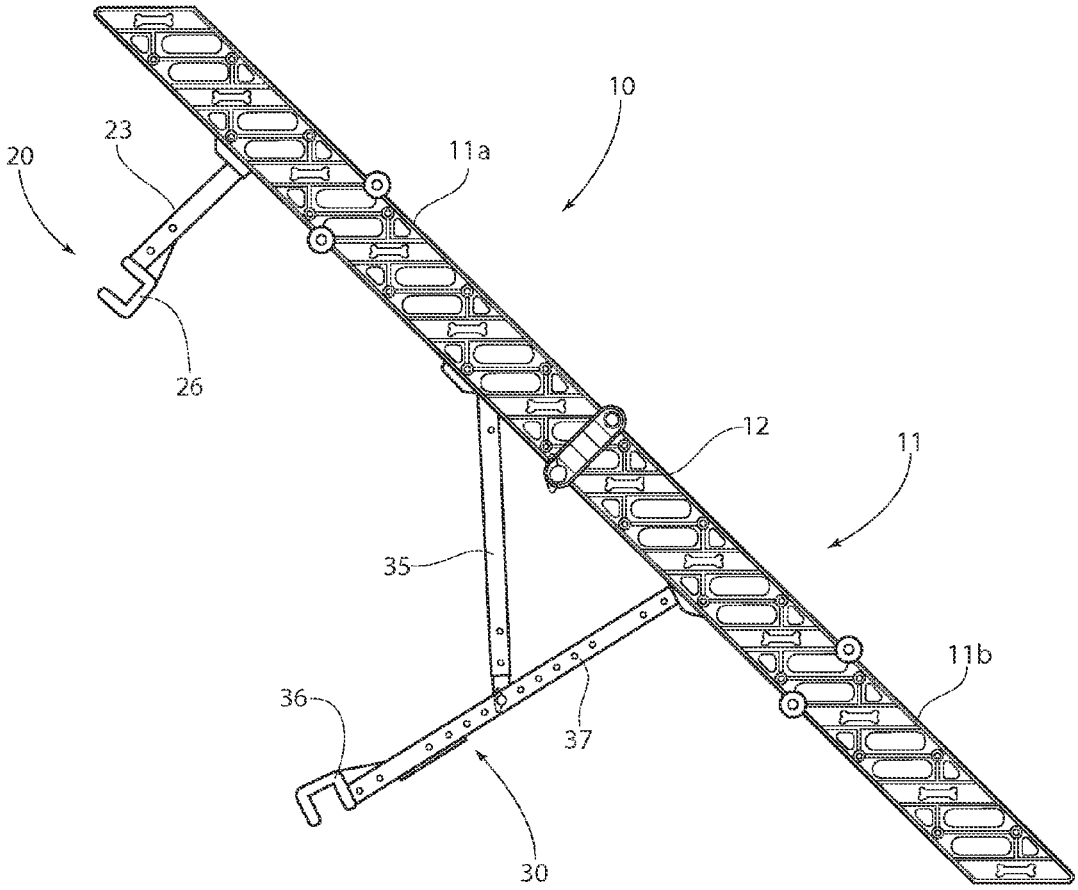

As shown in FIGS. 5A-5C, the apparatus 10 is also easily constructed and/or broken down as desired. FIG. 5A shows the apparatus 10 stored position, wherein the set of steps 11 is shown as two sections, 11*a* and 11*b*, which are folded inwardly around a pivot 70 to store the apparatus 10 in a compact form. The assemblies 20 and 30 are also pivoted inwardly to further provide a compact form for the apparatus 11. Various means (not shown) may be used to secure the apparatus in the stored position.

FIG. 5B demonstrates the steps 11 being folded outwardly, with the sections 11*a* and 11*b* being moved outwardly and secured in place for use. For example, a ball detent pin 72 may be used to secure the sections 11*a* and 11*b* in place. The ball detent pin 72 may also be used to assist in securing the two sections 11*a* and 11*b* together in a stored position, as shown in FIG. 5A.

Once the steps 11 are secured in an extended position, the mounting assemblies 20 and 30 are moved to an operable position, as shown in FIG. 5C. The apparatus may then be attached to a boat ladder 90, as previously described. If the apparatus 10 is to be removed for storage, the steps shown in FIGS. 5A-5C would be done in a reverse order. As such, the apparatus 10 is capable of being stored and assembled in a quick and efficient manner.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

I claim:

1. A boat boarding apparatus for boarding animals onto a boat having a boat ladder, said apparatus including:

a set of boarding steps;

a first mounting assembly attached to said boarding steps for connecting said boarding steps to said boat ladder, said first mounting assembly providing a resistance force for attaching said mounting assembly to said boat ladder, said first mounting assembly further comprises:

a pivot bar spanning said space in between two substantially parallel side runners, at least one mounting arm extending from said pivot bar, said arm having a proximal and a distal end, wherein said proximal end comprises an arm attachment ring that attaches around said pivot bar and said distal end comprises a hook having an open portion for engaging a rung of said boat ladder; and a second mounting assembly for connecting said boarding steps to said boat ladder, said second mounting assembly providing a second resistance force for attaching said mounting assembly to said boat ladder, wherein said first resistance force and said second resistance force being opposing forces to one another.

2. The boat boarding apparatus of claim 1 wherein said boat boarding steps further comprises a plurality of platforms spanning between said substantially parallel side runners and attached perpendicular to said parallel side runners, said platforms configured to create an inclined set of steps.

3. The apparatus of claim 2, wherein said platforms further comprise a plurality of apertures to limit the surface area of said platforms.

4. The boat boarding apparatus of claim 1, wherein said parallel side runners further comprises a plurality of apertures to limit the surface area of said side runners.

5. The boat boarding apparatus of claim 1 wherein said first resistance force further exerts a force on said mounting arm in a direction substantially parallel to said open portion of said hook.

6. The boat boarding apparatus of claim 1, wherein said second mounting assembly further comprises:

an upper pivot bar and a lower pivot bar each spanning said space in between said parallel side runners, and a pair of spaced apart mounting arms that extend from said lower pivot bar, each pair of mounting arms further having a proximal and a distal end, wherein said proximal end comprises an arm attachment ring that attaches around said lower pivot bar and said distal end comprises a hook having an open portion for engaging a rung of said boat ladder.

7. The boat boarding apparatus of claim 6 wherein each of said pair of mounting arms of said second mounting assembly has a channel with an opening facing upwardly and a pair of sidewalls, said sidewalls having apertures, said mounting assembly further comprises:

a pair of spaced apart brace arms that extend from said upper pivot bar, each having a proximal end and a distal end, wherein said proximal end comprises an arm attachment ring that attaches around said upper pivot bar and said distal end comprises a connection end sized and configured to engage a pair of said apertures in said sidewalls of said channel on said mounting arms.

8. The apparatus of claim 7, wherein said means for exerting force on said mounting arms are torsion springs acting on said mounting arms of first mounting assembly and said mounting arms of said second mounting assembly.

9. The apparatus of claim 7, wherein said means for exerting force on said mounting arms are selected from: torsion springs, gas struts, elastic bands, compression springs, extension springs, or combinations thereof; said force acting on said mounting arms of first mounting assembly and said mounting arms of said second mounting assembly.

10. A boat boarding apparatus for boarding animals onto a boat having a boat ladder, said apparatus including:

a set of boarding steps;

a first mounting assembly attached to said boarding steps for connecting said boarding steps to said boat ladder, said first mounting assembly providing a resistance force for attaching said mounting assembly to said boat ladder;

and a second mounting assembly for connecting said boarding steps to said boat ladder, said second mounting assembly providing a second resistance force for attaching said mounting assembly to said boat ladder, wherein said first resistance force and said second resistance force being opposing forces to one another, wherein said each of said first and said second mounting assemblies further comprises a pair of hooks having an open portion for attaching said assemblies to said boat ladder, said open portions of said hooks of said first mounting assembly face in an opposite direction from said open portions of said hooks of said second mounting assembly.

11. The apparatus of claim 10 wherein said open portions of said hooks of said first mounting apparatus face in towards said open portions of said hooks of said second mounting apparatus.

12. A boat boarding apparatus for boarding animals onto a boat having a boat ladder, said apparatus including:

a set of boarding steps;

a first mounting assembly attached to said steps, said first mounting assembly comprising a hook pivotally connected to said boat boarding steps for connecting said boarding steps to said boat ladder;

a second mounting assembly attached to said boarding steps said second mounting assembly comprising a hook for connecting said boarding steps to said boat ladder, wherein said hook of said first mounting assembly is arranged to form an opposing force to said hook of said second mounting assembly, thereby providing a positive engagement with said boat ladder wherein said first mounting assembly further comprises biasing means for engaging said first mounting assembly hook with said boat ladder.

13. The apparatus of claim 12, wherein the hook of said second mounting assembly are rigidly positioned with respect to said boat ladder.

14. The apparatus of claim 12, wherein said first mounting assembly comprises at least two hooks pivotally connected to said boat boarding steps.

15. The apparatus of claim 12, wherein said second mounting assembly comprises at least two hooks for connecting said boarding steps to said boat ladder.

16. A method for boarding an animal onto a boat having a ladder, comprising the steps of:

providing a boat boarding apparatus, said apparatus comprising:

an inclined set of steps comprised of at least two parallel side runners and a plurality of platforms spanning said space in between said parallel side runners and attached perpendicular to said parallel side runners;

a first mounting assembly further comprising:

a pivot bar spanning said space in between said parallel side runners, at least one mounting arm that extends from said pivot bar, said mounting arm having a proximal and a distal end, wherein said proximal end comprises an arm attachment ring that attaches around said pivot bar and said distal end comprises a hook having an open portion for engaging a rung of said boat ladder, and a means for exerting a force on said mounting arm in a direction substantially parallel to said open portion of said hook, and a second mounting assembly further comprising:

an upper pivot bar and a lower pivot bar each spanning said space in between said parallel side runners, at least one mounting arm that extends from said lower pivot bar, said at least one mounting arm having a channel with an opening facing upwardly and a pair of sidewalls, said sidewalls having apertures, and said at least one mounting arm further having a proximal and a distal end, wherein said proximal end comprises an arm attachment ring that attaches around said lower pivot bar and said distal end comprises a hook having an open portion for engaging a rung of said boat ladder, and at least one brace arm that extends from said upper pivot bar, said at least one brace arm having a proximal end and a distal end, wherein said proximal end comprises an arm attachment ring that attaches around said upper pivot bar and said distal end comprises a connection end sized and configured to engage a pair of said apertures in said sidewalls of said channel on said at least one mounting arm;

adjusting said second mounting apparatus by sliding said connection end of said brace arm along said channel of said at least one mounting arm until said at least one mounting arm reaches the desired position, then engaging said connection end within said apertures of said sidewalls of said channels;

positioning said hook of said second mounting apparatus relative to a rung of said boat ladder;

exerting an external force on said mounting arm of said first mounting apparatus in a direction opposite a force created by said means for exerting a force;

positioning said apparatus with said hook of said first mounting assembly relative to a second rung of said boat ladder; and releasing said external force on said mounting arm of said first mounting arm whereby said means for exerting force on said mounting arm causes said hook to engage said second rung of said boat ladder.

17. The method of claim 16 further comprising the steps of exerting an external force on said mounting arm of said first mounting apparatus, that is engaged with a rung of said boat ladder, in a direction opposite a force created by said means for exerting a force, disengaging said hook of said first mounting assembly from said rung of said boat ladder, disengaging said hook of said second mounting apparatus, and pulling said boat boarding apparatus away from said boat ladder.

* * * * *